US006606804B2

(12) United States Patent
Kaneko et al.

(10) Patent No.: US 6,606,804 B2
(45) Date of Patent: Aug. 19, 2003

(54) WRAP CLOSURE AND FIT SYSTEM OF FOOTWEAR

(75) Inventors: Yasunori Kaneko, Osaka (JP); Kenjiro Kita, Osaka (JP); Kazuhiko Suzuki, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/766,367

(22) Filed: Jan. 19, 2001

(65) Prior Publication Data

US 2001/0034958 A1 Nov. 1, 2001

(51) Int. Cl.[7] ..... A43B 7/14; A43B 23/28

(52) U.S. Cl. ..... 36/88; 36/58.5; 36/50.1

(58) Field of Search ..... 36/58.5, 88, 91, 36/92, 50.1

(56) References Cited

U.S. PATENT DOCUMENTS

| | | | | |
|---|---|---|---|---|
| 4,107,857 A | | 8/1978 | Devlin | 36/129 |
| 4,200,997 A | | 5/1980 | Scheinhaus et al. | 36/11.5 |
| 4,245,408 A | | 1/1981 | Larsen et al. | 36/50 |
| 4,275,513 A | | 6/1981 | Antonious | 36/50 |
| 4,282,657 A | | 8/1981 | Antonious | 36/50 |
| 4,296,558 A | | 10/1981 | Antonious | 36/50 |
| 4,510,701 A | | 4/1985 | Schour et al. | 36/68 |
| 4,562,654 A | | 1/1986 | Hue | 36/117 |
| 4,670,998 A | | 6/1987 | Pasternak | 36/114 |
| 4,679,334 A | | 7/1987 | McBride | 36/114 |
| 4,766,679 A | * | 8/1988 | Bender | 36/30 R |
| 4,793,075 A | | 12/1988 | Thatcher | 36/11.5 |
| 4,800,659 A | * | 1/1989 | Marega | 24/69 SK |
| 4,811,500 A | * | 3/1989 | Maccano | 36/117.9 |
| 4,845,055 A | * | 7/1989 | Ogata | 438/308 |
| 5,109,613 A | * | 5/1992 | Van Dyke | 36/114 |
| 5,379,530 A | * | 1/1995 | Bell et al. | 36/89 |
| 5,392,535 A | | 2/1995 | Van Noy et al. | 36/88 |

(List continued on next page.)

FOREIGN PATENT DOCUMENTS

| | | |
|---|---|---|
| EP | 590 320 | 8/1993 |
| JP | 56-35043 | 8/1981 |
| JP | 64-3363 | 1/1989 |
| JP | 4-50809 | 12/1992 |
| JP | 8-317801 | 12/1996 |
| JP | 2000-4905 | * 1/2000 |
| JP | 2000-14407 | 1/2000 |

*Primary Examiner*—M. D. Patterson
(74) *Attorney, Agent, or Firm*—Troutman Sanders LLP; Gerald R. Boss

(57) ABSTRACT

The present invention relates to a tightening system for footwear, especially in athletic shoe, and is directed to improve the fittability, supportability and stability of the shoe. The athletic shoe of the present invention includes a supporting portion (Fs) for supporting the lateral side of a foot of a shoe wearer, a first fastening element of a loop shape that surrounds the periphery of the calcaneus (f2) of the foot, and a second fastening element of a loop shape that is provided integrally with the supporting portion (Fs). The supporting portion(Fs) extends from the position in the vicinity of the head of the metatarsus on the lateral side of the foot over the rear portion of the calcaneus of the foot to the medial side. The first fastening element, which is integrated with the terminus (Fs') of the supporting portion (Fs), extends upwardly to the position corresponding to the navicular (f3) on the medial side, and passes over the instep above the navicular (f3), and returns to the lateral side of the foot and to the calcaneus lateral side of the supporting portion (Fs). The second fastening element extends from the medial side to the lateral side on the rear side of the base position of the proximal phalanx (f4) of the foot. The first and second fastening elements include medial side, lateral fastening elements (F1'), (F2') that are provided on the lateral side, and joining parts that join the medial fastening elements to the corresponding lateral fastening elements.

20 Claims, 10 Drawing Sheets

U.S. PATENT DOCUMENTS 5,408,761 A 4/1995 Gazzano ..... 36/88
5,465,506 A 11/1995 Matis et al. ..... 36/11.5
5,475,935 A * 12/1995 Frost ..... 36/88
5,497,564 A * 3/1996 Allen et al. ..... 24/713.7
D368,798 S 4/1996 Tong ..... D2/969
D368,799 S 4/1996 Lozano ..... D2/969
5,502,902 A * 4/1996 Sussmann ..... 24/714.7
5,692,319 A 12/1997 Parker et al. ..... 36/50.1
5,819,439 A * 10/1998 Sanchez ..... 36/50.1
5,893,221 A 4/1999 Weissman et al. ..... 36/91
5,896,684 A 4/1999 Lin ..... 36/101
5,933,985 A * 8/1999 James ..... 36/50.1

* cited by examiner

WRAP CLOSURE AND FIT SYSTEM OF FOOTWEAR

This application claims priority based on Application PCT/JP00/02836, filed on Apr. 28, 2000 entitled "Wrap Closure and Fit System of Footwear".

TECHNICAL FIELD

The present invention relates to a tightening structure or a wrap closure and fit system of an article of footwear, and more particularly, a system for wrapping a foot of a shoe wearer in a loop shape and securing an article of footwear to the foot.

BACKGROUND OF THE INVENTION

Generally, in use of an athletic shoe, the fit or fittability of the shoe is important to a shoe wearer especially at the heel portion of the shoe. Various techniques have been utilized to improve the fittability of the shoe at its heel portion.

For example, Japanese patent application examined publication or Kokoku No. 63-30001 discloses a shoe that has a pair of fastening members attached to the inside of the rear portion of the shoe upper in order to fasten the upper front position of a talus of a foot of a shoe wearer toward a calcaneus of the foot. Japanese utility model registration No. 3038156 shows a shoe that has a highly strengthened first belt member extending from the heel portion to the upper portion of the eyelets and a highly strengthened second belt member extending from the plantar arch portion to the instep, whereby the shoe upper is tightened.

In the methods shown in the above-mentioned Japanese publications, a certain degree of effect is achieved to improve the fittability of the shoe at the heel portion. However, in these methods, deformation of the shoe during sports and slippage of the foot inside the shoe cannot be prevented. Also, in these methods, at the time of the weight shift of the shoe wearer, sinking of the inside arch or plantar arch portion of the foot cannot be prevented either.

In general, deformation of a shoe during sports and slippage of a foot inside the shoe can be prevented by attaching a reinforcing member of high rigidity or a heel counter to a heel portion of the shoe. However, in this case, to provide the heel counter results in the increased number of shoe components and decreased productivity. Accordingly, there is provided a shoe with a reinforcing member that covers the whole heel portion and is formed integrally with the midsole so as to decrease the number of the shoe components (see Japanese patent application laying open publication or Kokai No. 5-199901). But, in this case, there arise disadvantages of the increased weight of the whole shoe and decreased ventilation of the shoe. In addition, providing a projection at the insole can prevent the inside arch from sinking at the time of the weight shift of the shoe wearer. However, in this case, the number of shoe components increases and productivity decreases.

We, inventors of the present invention have been biodynamically analyzing the stress applied to a shoe and the foot of a shoe wearer at the time of playing sports. By this analysis, we have found that it is important to provide a side wall or a supporting portion along a lateral region extending from the head of the fifth metatarsus to the calcaneus of the foot in order to prevent the foot from slipping in the lateral or transverse direction inside the shoe. We have also found that a supporting structure of the navicular is important to prevent the plantar arch portion of the foot from sinking during sports as a result of an anatomical analysis of a skeletal structure of the foot. Consequently, if these supporting elements can be made integral with an element for preventing the foot from slipping forward inside the shoe during sports, we suppose that an athletic shoe satisfying both the fittability and supportability can be achieved with a minimum of shoe components.

The present invention has been made in view of this standpoint, and its object is to provide a tightening structure or a wrap closure and fit system of an article of footwear and an athletic shoe that can improve the fittability, supportability and stability with a minimum of shoe components.

SUMMARY OF THE INVENTION

A first invention provides a tightening structure of footwear for wrapping a foot of a shoe wearer in a loop shape. The structure of the first invention includes a supporting member to support the lateral side of the foot, which extends from the position near the head of the metatarsus on the lateral side of the foot over the rear portion of the calcaneus to the medial side of the foot. The structure also includes a first fastening element of a loop shape, which is formed integrally with the terminus or the proximal end of the supporting member, and extends upwardly toward the position of the navicular on the medial side, and passes over the instep of the foot above the navicular, and returns to the lateral side of the foot and to the lateral side of the calcaneus of the supporting member.

In this case, the supporting member can prevent a transverse slippage or slippage toward the lateral side of the foot inside the footwear at the time of landing onto the ground. Moreover, by providing the first fastening element of a loop shape, an instep supporting portion of the first fastening element, which passes over the instep of the foot, can prevent the forward slippage of the foot inside the footwear on landing. Furthermore, an inside wall portion of the first fastening element, which extends upwardly toward the navicular of the foot on the medial side, supports the navicular to raise it up with the navicular wrapped or enclosed in the inside wall portion. Thus, at the time of the weight shift from the heel portion to the forefoot portion, sinking of the inside arch can be prevented, thereby preventing an excessive inclination of the foot toward the medial side and improving the heel stability.

Also, in this case, because the first fastening element is integrated with the supporting member, both the fittability and supportability of the footwear can be satisfied with a minimum of shoe components.

In addition, the term "loop" in the first invention means annular.

A second invention provides a similar tightening structure of footwear for wrapping the foot of a shoe wearer in a loop shape. The structure of the second invention includes a supporting member to support the lateral side of the foot, which extends from the position near the head of the metatarsus on the lateral side of the foot over the rear portion of the calcaneus to the medial side of the foot. The structure also includes a second fastening element of a loop shape, which is formed integrally with the supporting member, and extends between the medial side and the lateral side on the rear side of the base of the proximal phalanx of the foot. In this case, the supporting member can prevent a transverse slippage or slippage toward the lateral side of the foot inside the footwear at the time of landing onto the ground. Moreover, by providing the second fastening element of a loop shape, an instep supporting portion of the second fastening element, which passes over the instep of the foot, can prevent the forward slippage of the foot inside the footwear on landing.

Furthermore, in this case, because the second fastening element is integrated with the supporting member, both the fittability and supportability of the footwear can be satisfied with a minimum of shoe components.

In addition, the term "loop" in the second invention is used with the meaning of a slightly curved circular arc.

The upper end of each of the supporting members in the first and second inventions is preferably placed at the position in the vicinity of 'a swell line' around the outer circumference of the foot of the shoe wearer, that is, a line forming the contour of a horizontally projected plan of the foot, or in other words, a line connecting the most projected or protruded portions around the outer circumference of the foot. More preferably, the upper end of the height of the supporting member is slightly beyond this swell line.

The first and second fastening elements each may be formed of medial fastening elements provided on the medial side, lateral fastening elements provided on the lateral side, and joining or securing parts that join these medial and lateral fastening elements. The termini or distal ends of the medial fastening elements are preferably disposed on the lateral side beyond a center line of the shoe. This is for wrapping or enclosing the wider areas of the lateral navicular position to prevent a local excessive pressure, and for preventing each of the fastening elements of a left and right shoe from interfering with each other.

An athletic shoe is a favorable example of footwear to which the first and second inventions are applied, and in the athletic shoe, at least portions of the medial and lateral fastening elements may be provided outside or inside the shoe upper, or in the shoe upper. Also, each of the proximal ends of the medial and lateral fastening elements of the shoe may be anchored to the shoe upper or the heel portion of a midsole, and each of the distal ends of the medial and lateral fastening elements may be connected to the joining part, and each of the intermediate portions of the medial and lateral fastening elements may be disconnected from the shoe upper. Additionally, in the athletic shoe to which the present invention is applied, a corrugated sheet having a corrugation may be provided at least at the heel portion of the midsole formed of a soft elastic material.

BRIEF DESCRIPTION OF THE DRAWINGS

FIG. 1A is a medial side view of the tightening structure of the present invention.

FIG. 1B is a top plan view of the tightening structure of the present invention.

FIG. 1C is a lateral side view of the tightening structure of the present invention.

DETAILED DESCRIPTION OF THE PREFERRED EMBODIMENTS

Tightening Structure

Figure 1A:
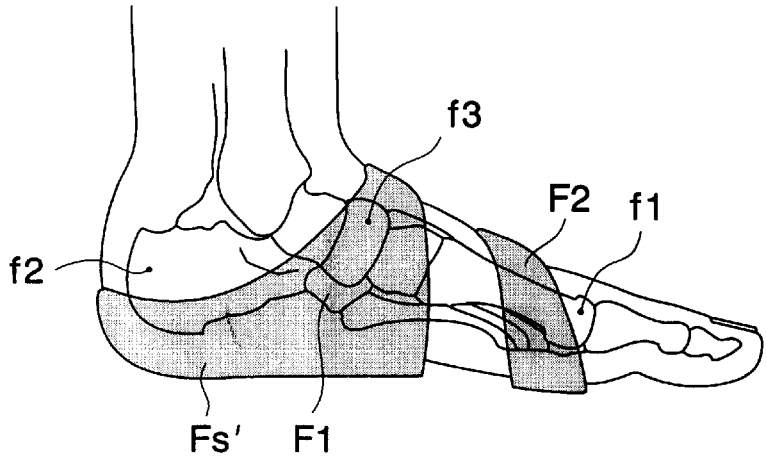
FIGS. 1A to 1C are schematic diagrams each illustrating a tightening structure for footwear according to the present invention.
Figure 1B:
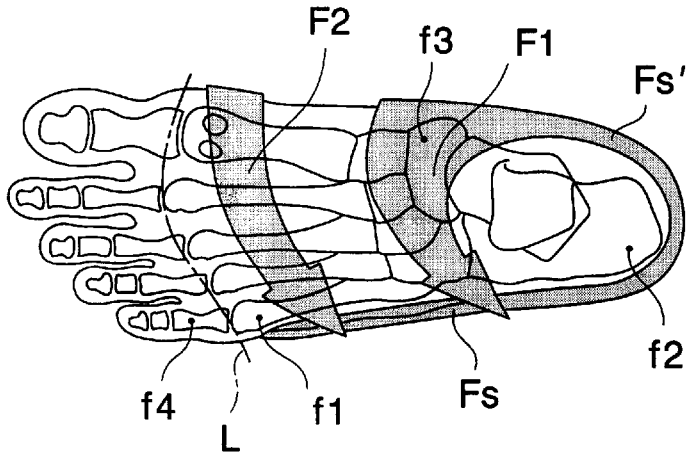
Figure 1C:
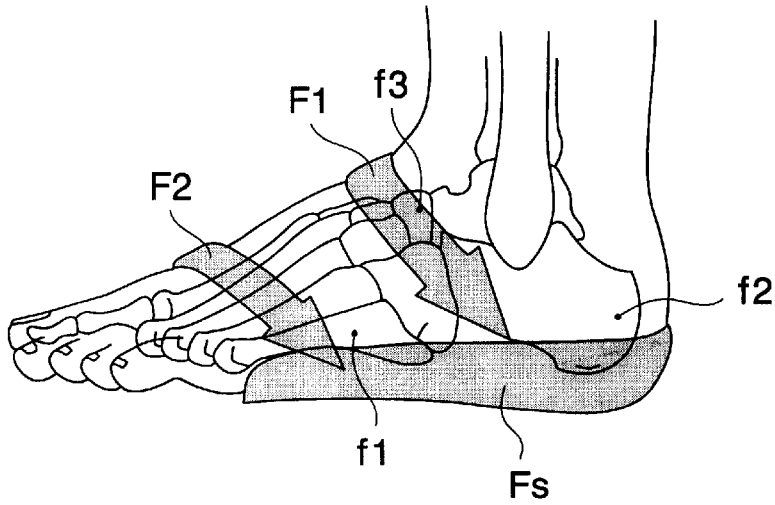

Referring now to the drawings, a tightening structure for footwear of the present invention is shown in FIGS. 1A to 1C. These figures show the condition in which the tightening structure of a loop shape of the present invention is directly wrapped around a foot of a shoe wearer. Therefore, when this tightening structure is applied to an actual article of footwear, by providing a sole under the tightening structure, the footwear will function as a sandal, and by further providing an upper on the sole, the footwear will function as an athletic shoe for sports such as running, track, basketball, baseball, volleyball, soccer, tennis, golf or the like.

This tightening structure of a loop shape includes a supporting portion (Fs), which extends from the position near the head of the metatarsus (f1) on the lateral side of the foot of the shoe wearer over the rear portion of the calcaneus (f2) to the medial side of the foot, and a first fastening element (F1) of a loop shape, which is formed integrally with and extends from the terminus (Fs') or the proximal end of the supporting portion (Fs) to surround or enclose the outer circumference of the calcaneus (f2), and extends upwardly toward the position of the navicular (f3) on the medial side, and passes over the instep of the foot above the navicular (f3), and returns to the lateral side of the foot and to the lateral side of the calcaneus (f2) of the supporting portion (Fs). Moreover, the fastening structure of a loop shape also includes a second fastening element (F2) of a loop shape, which extends between the medial and lateral sides on the rear side of the base of the proximal phalanx (f4) of the foot of the shoe wearer.

In addition, a curved line L in FIG. 1B shows a base line of the proximal phalanx (f4) that are disposed in front of the metatarsus (f1). An arrow mark of each distal end of the first and second fastening elements (F1) and (F2) in FIGS. 1B, 1C depicts the condition in which each fastening element is anchored and fastened to the supporting portion (Fs).

In this case, the supporting portion (Fs) can prevent a transverse slippage or slippage toward the lateral side of the foot inside the footwear at the time of landing onto the ground. Moreover, by providing the first fastening element (F1) of a loop shape, an instep supporting portion of the first fastening element (F1), which passes over the instep of the foot, can prevent a forward slippage of the foot inside the footwear on landing. Furthermore, by providing the second fastening element (F2) of a loop shape, an instep supporting portion of the second fastening element (F2), which passes over the instep of the foot, can further prevent the forward slippage of the foot inside the footwear on landing. Also, an inside wall portion of the first fastening element (F1), which extends upwardly toward the navicular (f3) of the foot on the medial side, supports the navicular (f3) to raise it up with the navicular (f3) wrapped or enclosed in the inside wall portion. Thus, at the time of the weight shift from the heel portion to the forefoot portion, sinking of the inside arch can be prevented, thereby preventing an excessive inclination of the foot toward the medial side and improving the heel stability.

Moreover, in this case, because the first and second fastening elements (F1) and (F2) are integrated with the supporting portion (Fs), both the fittability and supportability of the footwear can be satisfied with a minimum of shoe components. The upper end of the supporting portion (Fs) is preferably placed at the position in the vicinity of 'a swell line' around the outer circumference of the foot of the shoe wearer. The swell line is a line that forms a contour of a horizontally projected plan of the foot, or in other words, a line connecting the most projected or protruded portions around the outer circumference of the foot. More preferably, the upper end of the supporting portion (Fs) is slightly beyond this swell line.

In addition, the term "loop" is used with the meaning including not only annular but curved with a slightly circular arc.

Now, a number of embodiments in each of which the tightening structure of the present invention is applied to an athletic shoe are described in detail hereinafter.

First Embodiment

Figure 2A:
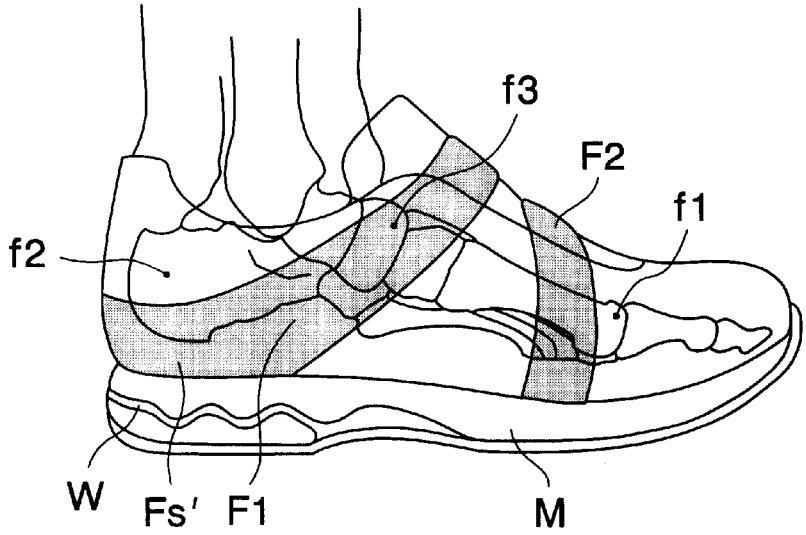
FIG. 2A is a medial side schematic view of an athletic shoe employing the tightening structure of the first embodiment of the present invention.
Figure 2B:
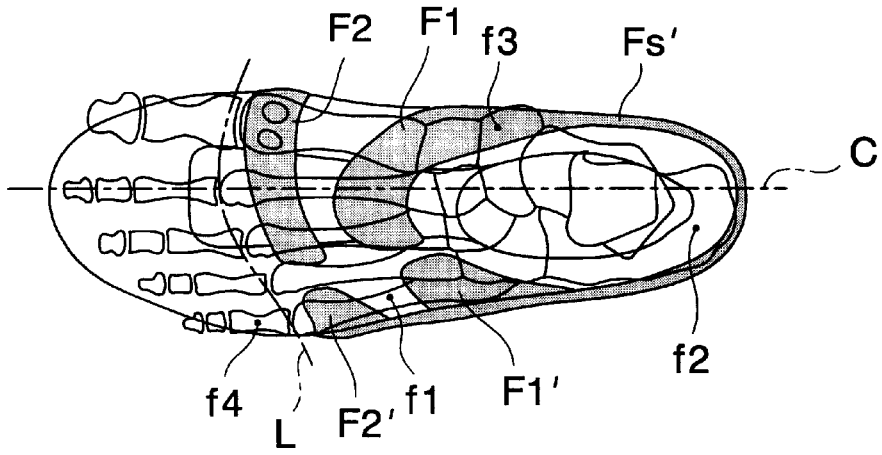
FIG. 2B is a top plan schematic view of the athletic shoe of FIG. 2A.
Figure 2C:
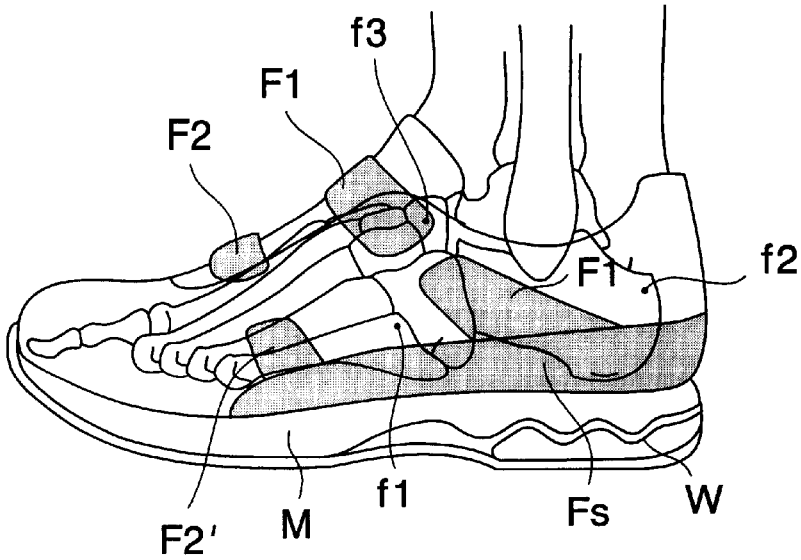
FIG. 2C is a lateral side schematic view of the athletic shoe of FIG. 2A.

FIGS. 2A to 2C show a first embodiment of the present invention. In FIGS. 2A to 2C, the same reference characters as those in FIGS. 1A to 1C indicate the same or corresponding portions.

In this first embodiment, a first fastening element of a loop shape is formed of a medial fastening element (F1) disposed on the medial side in a band shape and a lateral fastening element (F1') disposed on the lateral side. The medial fastening element (F1) extends obliquely and upwardly from the terminus (Fs') or the proximal end of the supporting portion (Fs) to the position corresponding to the navicular (f3). Similarly, a second fastening element of a loop shape is formed of a medial fastening element (F2) disposed on the medial side in a band shape and a lateral fastening element (F2') disposed on the lateral side. In the drawings, a predetermined clearance is provided between each medial fastening element and its corresponding lateral fastening element of the first and second fastening elements, and a joining part (not shown) may be provided at this clearance to join the medial and lateral fastening elements. The joining part may be a shoelace, hook-and-loop fastener, snap fastener, buckle or the like. Either or both the medial and lateral fastening elements may be elongated and both the fastening elements may be overlapped.

In addition, the termini or distal ends of the medial fastening elements of the first and second fastening elements are preferably placed on the lateral side beyond a shoe center line (C). This is for wrapping the wider regions corresponding to the navicular on the lateral side, so as not to cause a local pressure on the foot inside the shoe and also for preventing the mutual interference of the joining parts of a left and right shoe. A midsole (M) is bonded under the shoe upper, and a corrugated sheet (W) having a corrugation is inserted into the heel portion of the midsole (M).

In this case, the supporting portion (Fs) can prevent the transverse slippage or slippage toward the lateral side of the foot inside the shoe at the time of landing onto the ground. Moreover, by providing the medial fastening element (F1) of the first fastening element of a loop shape, an instep supporting portion of the medial fastening element (F1), which passes over the instep of the foot, can prevent the forward slippage of the foot inside the shoe on landing. Furthermore, by providing the medial fastening element (F2) of the second fastening element of a loop shape, an instep supporting portion of the medial fastening element (F2), which passes over the instep of the foot, can further prevent the forward slippage of the foot inside the shoe on landing. Also, an inside or medial wall portion of the medial fastening element (F1), which extends upwardly toward the navicular (f3) of the foot on the medial side, supports the navicular (f3) to raise it up with the navicular (f3) wrapped or enclosed in the inside wall portion. Thus, at the time of the weight shift from the heel portion to the forefoot portion, sinking of the inside arch can be prevented, thereby preventing an excessive inclination of the foot toward the medial side and improving the heel stability.

Also, in this case, because the lateral fastening elements (F1') and (F2') of the first and second fastening elements are integrated with the supporting portion (Fs), both the fittability and supportability as an athletic shoe can be satisfied with a minimum of shoe components.

The upper end of the supporting portion (Fs) is preferably placed at the position in the vicinity of 'a swell line' around the periphery of the foot of the wearer, that is, a line forming the contour of a horizontally projected plan of the foot, or in other words, a line connecting the most projected or protruded portions around the periphery of the foot. More preferably, the upper end of the supporting potion (Fs) is slightly beyond this swell line. Also, toes of the shoe wearer are not bound by each fastening element, and thus, they move freely, which allows for a strong ground-kicking and balance adjustment during sports.

In addition, the term "loop" is used with the meaning including not only annular but curved with a slightly circular arc.

Also, in this embodiment, the corrugated sheet (W) provided in the heel portion of the midsole (M) can prevent the heel of the foot from sinking more than necessary into the midsole (M) on landing, thereby preventing a transverse inclination of the foot after landing. Therefore, in this case, the heel stability can be further improved by the actions combined with the action of the corrugated sheet (W).

Figure 3A:
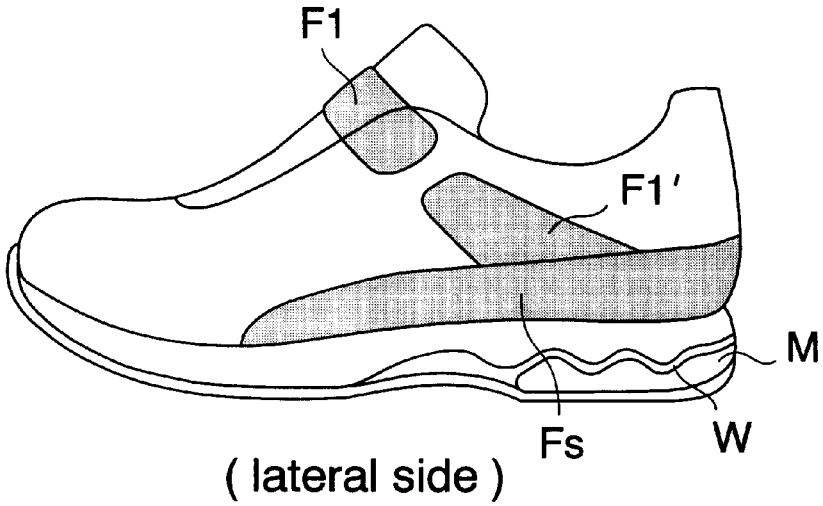
FIG. 3A is a lateral side schematic view of an athletic shoe employing the tightening structure of the second embodiment of the present invention.
Figure 3B:
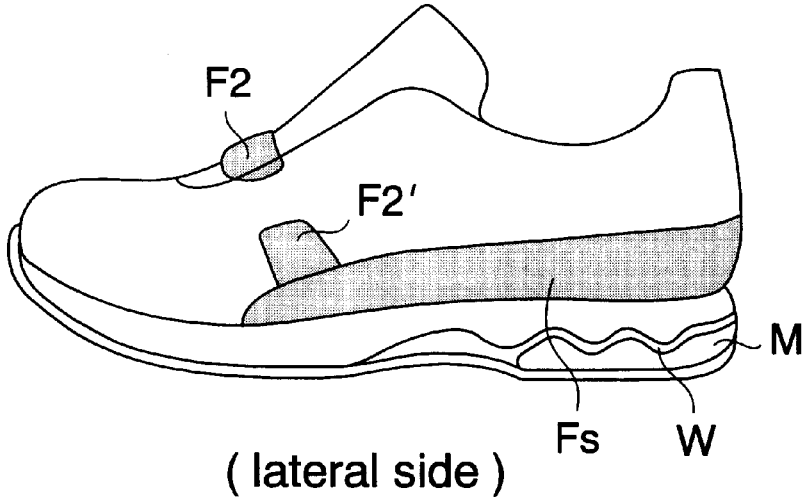
FIG. 3B is a lateral side schematic view of an athletic shoe employing the tightening structure of the third embodiment of the present invention.
Figure 3C:
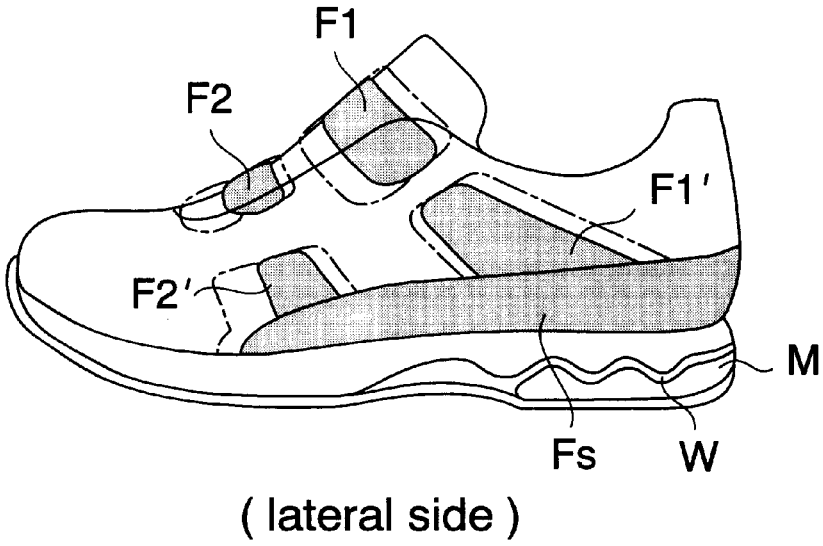
FIG. 3C is a schematic illustrating a variant of the tightening structure of the first embodiment of the present invention shown in FIG. 2C.

Each portion of the medial and lateral fastening elements (F1), (F1'), (F2) and (F2') can be changeable according to the characteristics and objects of sports (see a double dotted line of FIG. 3C).

Second Embodiment

FIG. 3A shows an athletic shoe employing the tightening structure of the second embodiment of the present invention. In this embodiment, only the first fastening element is provided and the second fastening element is not provided, which is a different feature than the first embodiment. In FIG. 3A, the same characters as those in the first embodiment indicate the same or corresponding parts.

The first fastening element of a loop shape includes a medial fastening element (F1) disposed on the medial side in a band shape and a lateral fastening element (F1') disposed on the lateral side. The medial fastening element (F1) extends diagonally and upwardly from the end of the supporting portion (Fs) to the position corresponding to the navicular. At a gap formed between the medial and lateral fastening elements (F1) and (F1') is provided a joining part such as a shoelace, hook-and-loop fastener, snap fastener, buckle or the like to join these medial and lateral fastening elements. The terminus or distal end of the medial fastening element (F1) is preferably positioned on the lateral side beyond the shoe center line. Additionally, a corrugated sheet (W) having a corrugation is inserted into the heel portion of the midsole (M).

In this embodiment, at the time of landing on the ground, the supporting portion (Fs) can prevent the transverse slippage of the foot toward the lateral side in the shoe, and an instep supporting portion of the medial fastening element (F1) can prevent the forward slippage of the foot in the shoe. Moreover, the inside wall portion of the medial fastening element (F1) supports the areas corresponding to the navicular of the foot to raise and enclose the navicular, thereby preventing sinking of the inside arch at the time of the weight shift from the heel portion to the forefoot portion. As a result, excessive inclination of the foot to the medial side can be prevented and thus, the heel stability can be advanced. Furthermore, by providing the lateral fastening element (F1') integrally with the supporting portion (Fs), both the fittability and supportability as a shoe can be achieved with a minimum of shoe components. Also, in this case, the heel stability can be further improved by the actions combined with the action of the corrugated sheet (W) interposed in the heel portion of the midsole (M).

Third Embodiment

FIG. 3B shows an athletic shoe employing the tightening structure of the third embodiment of the present invention. In this embodiment, only the second fastening element is provided and the first fastening element is not provided, which is a different feature from the first embodiment. In FIG. 3B, the same characters as those in the first embodiment indicate the same or corresponding parts.

The second fastening element of a loop shape includes a medial fastening element (F2) disposed on the medial side and a lateral fastening element (F2') disposed on the lateral side. At a gap formed between the medial and lateral fastening elements (F2) and (F2') is provided a joining part such as a shoelace, hook-and-loop fastener, snap fastener, buckle or the like to join these medial and lateral fastening elements. The terminus or distal end of the medial fastening element (F2) is preferably positioned on the lateral side beyond the shoe centerline. Additionally, a corrugated sheet (W) having a corrugation is inserted into the heel portion of the midsole (M).

In this embodiment as well, at the time of landing on the ground, the supporting portion (Fs) can prevent a transverse slippage of the foot toward the lateral side in the shoe, and an instep supporting portion of the medial fastening element (F2) can prevent a forward slippage of the foot in the shoe. Moreover, by providing the lateral fastening element (F2') integrally with the supporting portion (Fs), both the fittability and supportability as a shoe can be achieved with a minimum of shoe components. Furthermore, in this case, the heel stability can be further improved by the actions combined with the action of the corrugated sheet (W) interposed in the heel portion of the midsole (M).

In addition, it depends on the characteristics and objects of sports whether both the first and second fastening elements are provided, as shown in the first embodiment, or only the first or second fastening element is provided, as shown in the second or third embodiment, respectively.

Fourth Embodiment

Figure 4A:
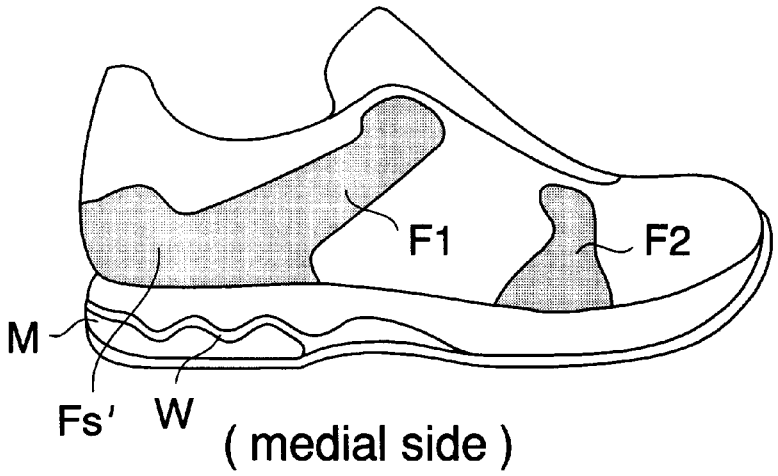
FIG. 4A is a medial side schematic view of an athletic shoe employing the tightening structure of the fourth embodiment of the present invention.
Figure 4B:
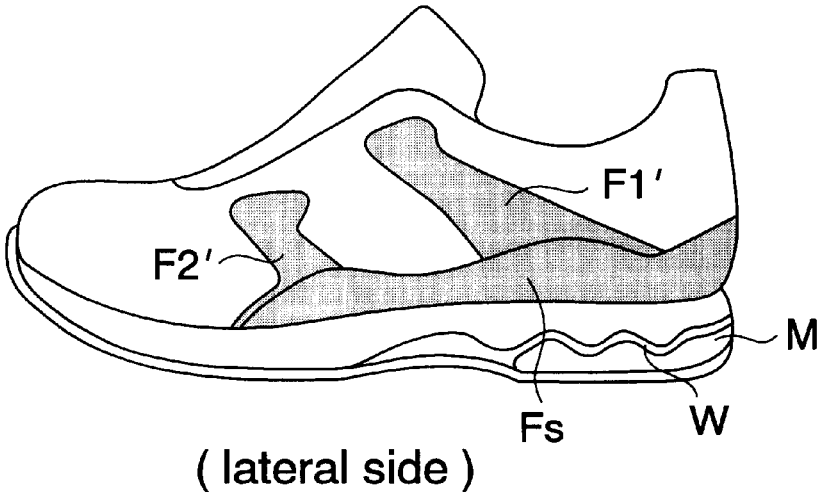
FIG. 4B is a lateral side schematic view of the athletic shoe of FIG. 4A.

FIGS. 4A and 4B show athletic shoes each employing the tightening structure of the fourth embodiment of the present invention. In the drawings, the same characters as those in the first embodiment indicate the same or corresponding parts.

This fourth embodiment is different from the first embodiment in that each distal end of the medial fastening elements (F1) and (F2) of the first and second fastening elements is positioned on the medial side, not beyond the shoe center line (C). The corresponding medial and lateral fastening elements are connected to each other by a joining part such as a shoelace, hook-and-loop fastener, snap fastener, buckle or the like. Also, in this embodiment, each of the fastening elements and supporting portion (Fs) has a different shape than a band shape shown in each of the aforementioned embodiments, which enhances an ornamental effect.

Fifth Embodiment

Figure 5A:
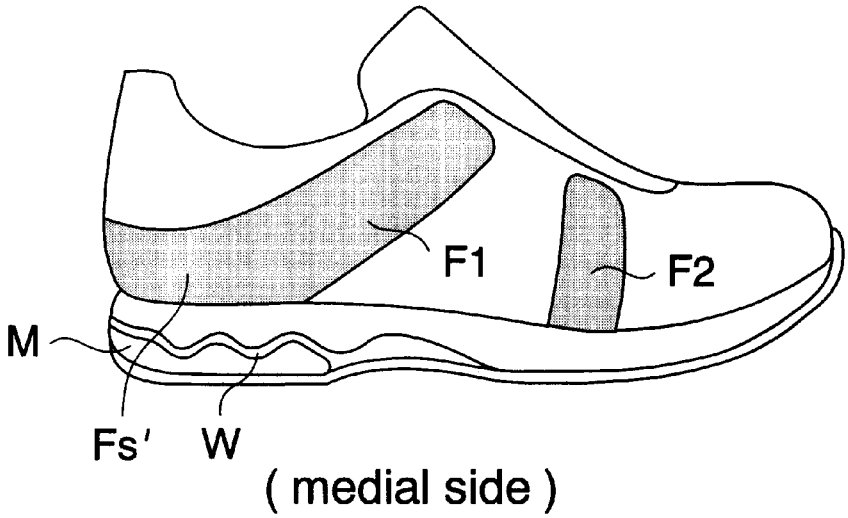
FIG. 5A is a medial side schematic view of an athletic shoe employing the tightening structure of the fifth embodiment of the present invention.
Figure 5B:
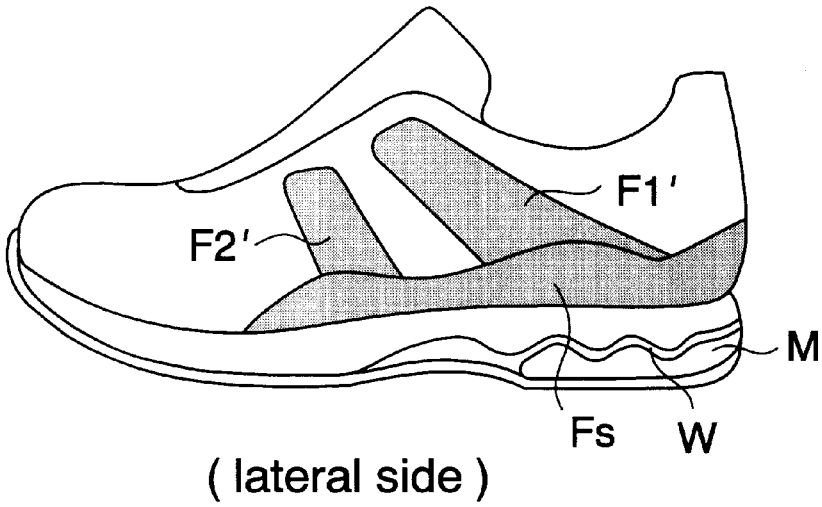
FIG. 5B is a lateral side schematic view of the athletic shoe of FIG. 5A.

FIGS. 5A and 5B show athletic shoes each employing the tightening structure of the fifth embodiment of the present invention. In the drawings, the same characters as those in the first embodiment indicate the same or corresponding parts.

In this embodiment, each of the second fastening elements (F2) and (F2') is provided at the rear position relative to the position shown in each of the aforementioned embodiments.

Sixth Embodiment

Figure 6A:
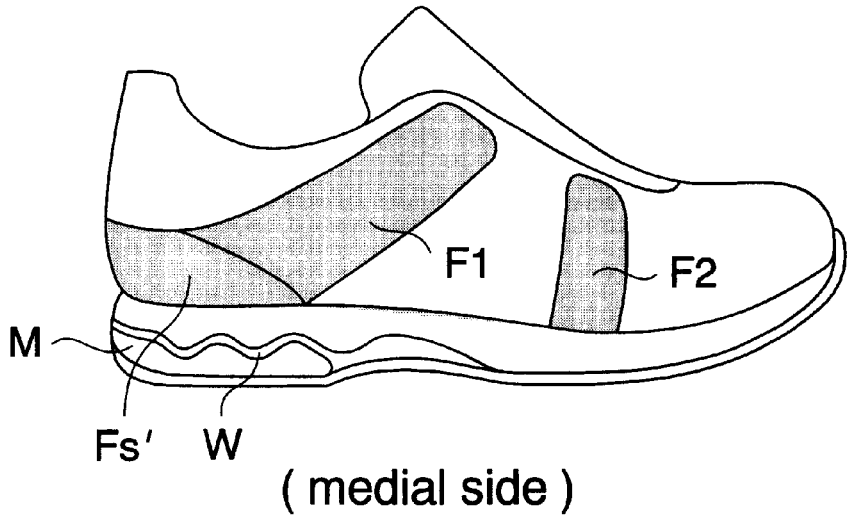
FIG. 6A is a medial side schematic view of an athletic shoe employing the tightening structure of the sixth embodiment of the present invention.
Figure 6B:
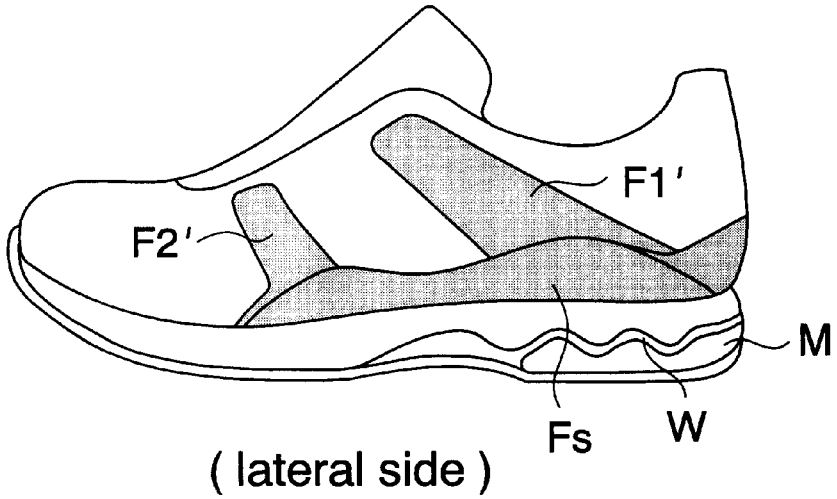
FIG. 6B is a lateral side schematic view of the athletic shoe of FIG. 6A.

FIGS. 6A and 6B show athletic shoes each employing the tightening structure of the sixth embodiment of the present invention. In the drawings, the same characters as those in the first embodiment indicate the same or corresponding parts.

In this embodiment, the supporting portion (Fs) is cut at the terminus (Fs'), which is not formed integrally with the first fastening element (F1). In this case, the first fastening element (F1) is connected to the terminus (Fs') directly or via the shoe upper. This sixth embodiment also has the same function and effect as the first embodiment.

Seventh Embodiment

Figure 7A:
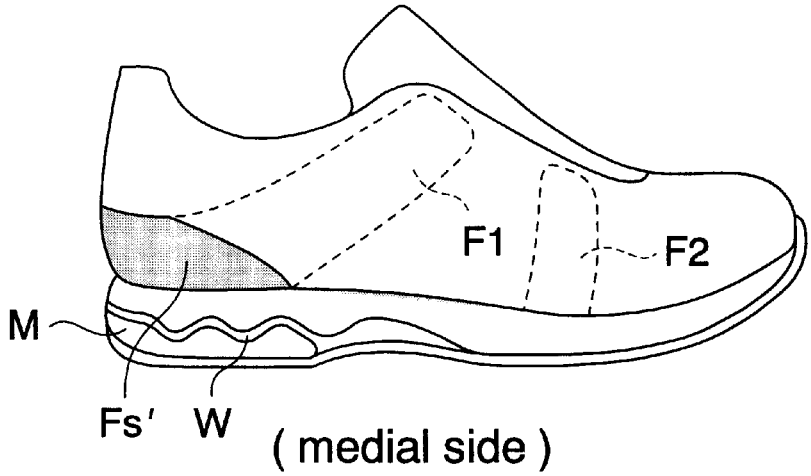
FIG. 7A is a medial side schematic view of an athletic shoe employing the tightening structure of the seventh embodiment of the present invention.
Figure 7B:
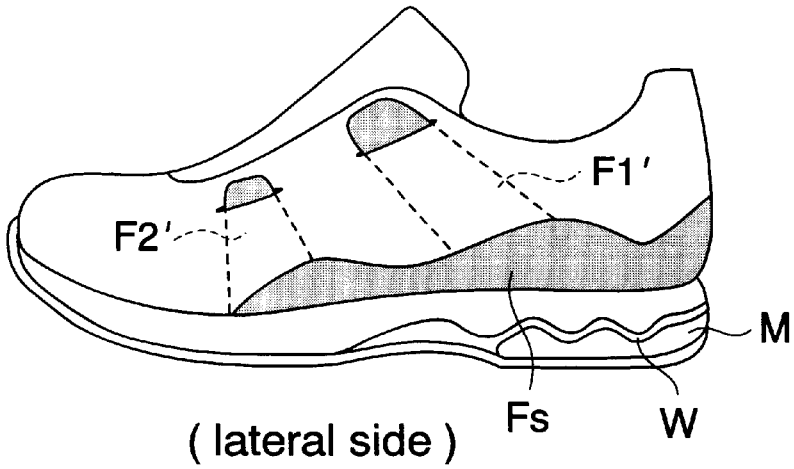
FIG. 7B is a lateral side schematic view of the athletic shoe of FIG. 7A.

FIGS. 7A and 7B show athletic shoes each employing the tightening structure of the seventh embodiment of the present invention. In the drawings, the same characters as those in the first embodiment indicate the same or corresponding parts.

In this embodiment, the first and second fastening elements are provided inside or in the shoe upper, while in each of the above-mentioned embodiments, the first and/or second fastening element is provided outside or on the shoe upper. Here, 'inside the shoe upper' means inside the inner cushioning materials of the shoe, and 'in the shoe upper' means in the inner cushioning materials of the shoe. Also, in this embodiment, each distal end of the lateral fastening elements (F1') and (F2') passes through a slit formed on the outer surface of the shoe upper and is disposed outside the upper. Additionally, either one of the first and second fastening elements may be placed inside or in the upper. Either case has the same function and effect as the first embodiment.

Eighth Embodiment

Figure 8A:
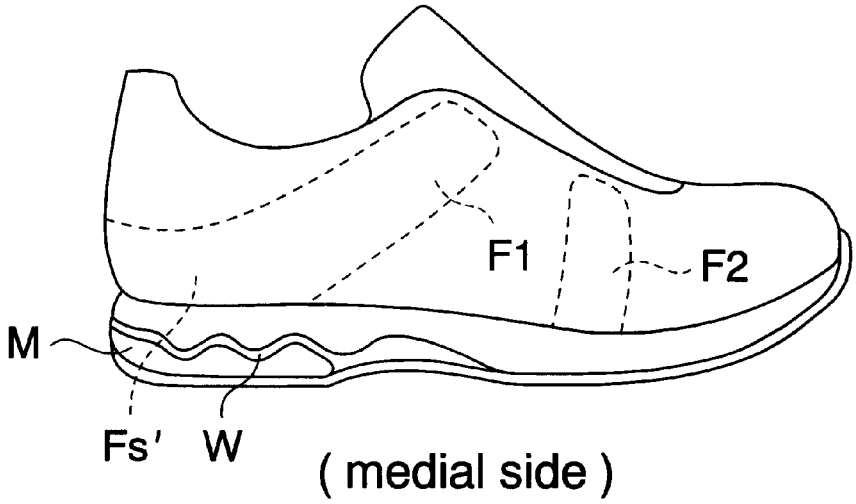
FIG. 8A is a medial side schematic view of an athletic shoe employing the tightening structure of the eighth embodiment of the present invention.
Figure 8B:
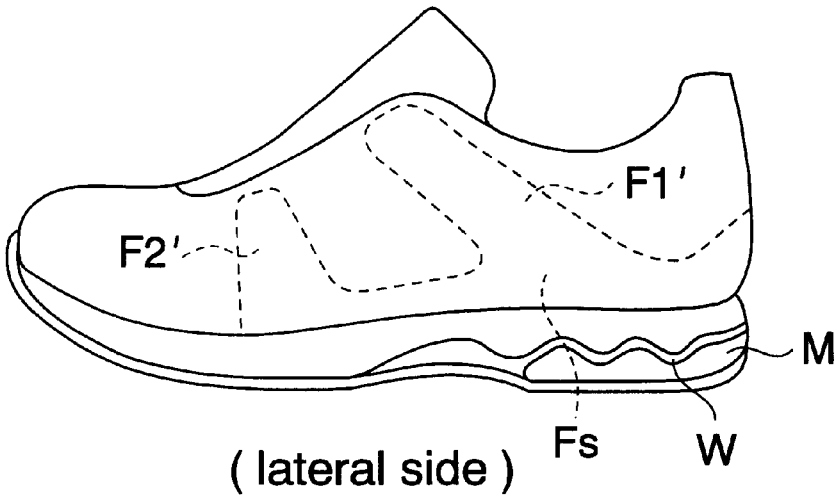
FIG. 8B is a lateral side schematic view of the athletic shoe of FIG. 8A.

FIGS. 8A and 8B show athletic shoes each employing the tightening structure of the eighth embodiment of the present invention. In the drawings, the same characters as those in the first embodiment indicate the same or corresponding parts.

In this embodiment, the supporting portion (Fs) is also positioned inside or in the shoe upper, which is a different feature from the seventh embodiment. This embodiment also has the same function and effect as the first embodiment.

Ninth Embodiment

Figure 9A:
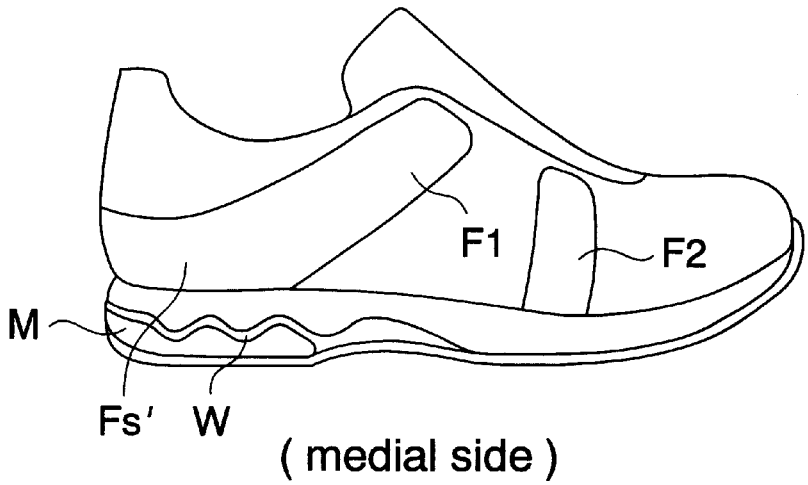
FIG. 9A is a medial side schematic view of an athletic shoe employing the tightening structure of the ninth embodiment of the present invention.
Figure 9B:
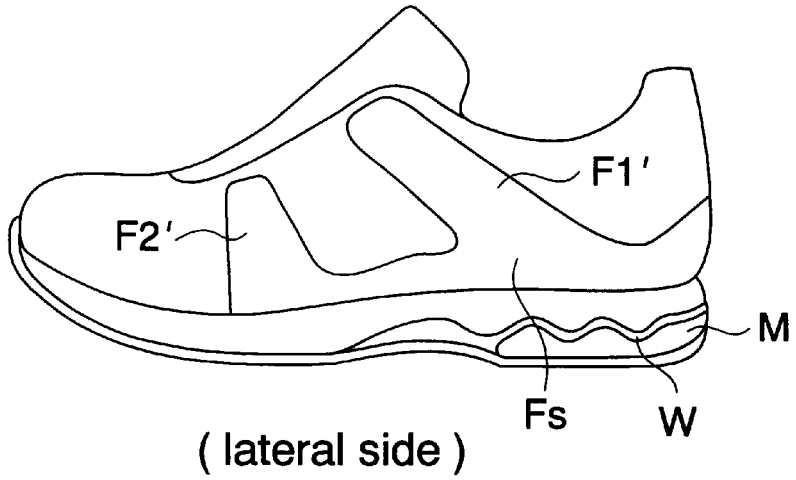
FIG. 9B is a lateral side schematic view of the athletic shoe of FIG. 9A.

FIGS. 9A and 9B show athletic shoes each employing the tightening structure of the ninth embodiment of the present invention. In the drawings, the same characters as those in the first embodiment indicate the same or corresponding parts.

In this embodiment, the fastening elements and the supporting portion (Fs) are formed by 'weldering', which is a different feature than the aforementioned embodiments. 'Weldering' is a working process such as partially embossing the shoe upper to form irregularities, or further injecting a silicon resin or the like into the embossed recesses to keep their shapes. This embodiment also has the same function and effect as the first embodiment. Also, in this embodiment, stiffness will be partially improved by pressing process in weldering and/or resin injection.

Tenth Embodiment

Figure 10:
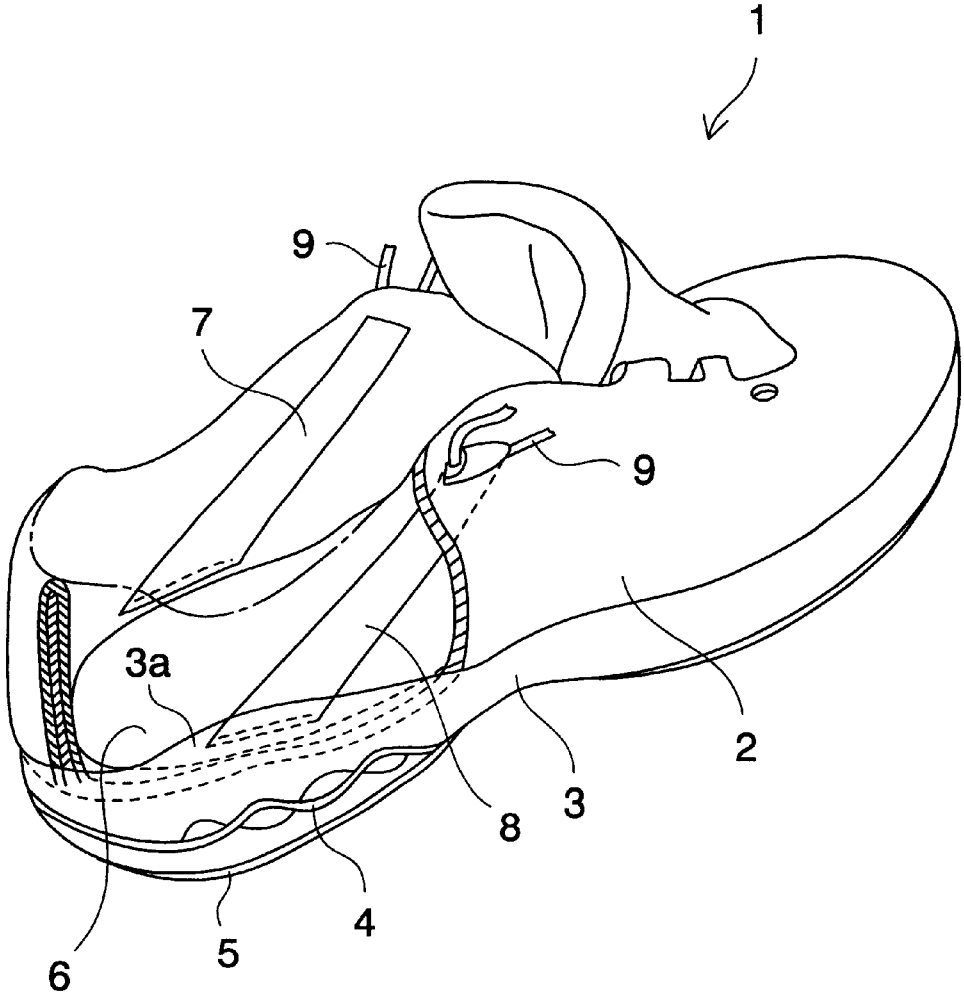
FIG. 10 is a cutaway perspective view of an athletic shoe employing the tightening structure of the tenth embodiment of the present invention.

FIG. 10 shows an athletic shoe employing the tightening structure of the tenth embodiment of the present invention. In the drawing, the same characters as those in the first embodiment indicate the same or corresponding parts.

An athletic shoe 1 is comprised of an upper 2, a midsole 3 that is bonded under the upper 2, a corrugated sheet 4 that is inserted into the heel portion of the midsole 3, and an outsole 5 that is bonded on the bottom face of the midsole 3. The midsole 3 has an upraised portion 3*a* that is raised upward from the surface of an insole 6 inside the shoe 1, and extends from the heel portion of the shoe 1 to the vicinity of a forefoot portion through the midfoot portion (or the arch of the foot). This upraised portion 3*a* corresponds to the supporting portion in each of the aforementioned embodiments. A pair of belt members 7, 8 are provided inside the upper 2. Each of the lower ends of the belt members 7, 8 is fixed to the side wall of the heel portion inside the upper 2 by stitching, bonding or the like. The belt members 7, 8 extend obliquely and upwardly toward the position corresponding to the navicular of the foot, and each of the upper ends of the belt members 7, 8 passes through a slit formed in the top portion of the upper 2, and is connected to a shoelace 9. The intermediate portions of the belt members 7, 8 are not connected to the inside of the upper 2. The lower ends of the belt members 7, 8 may be inserted between the insole 6 and midsole 3, and bonded therebetween.

In this embodiment, at the time of landing, the upraised portion 3*a* can prevent a transverse slippage of the foot toward the lateral side inside the shoe, and the shoelace 9 connected to the belt members 7, 8 can prevent a forward slippage of the foot inside the shoe. Moreover, in this case, each of the belt members 7, 8 is provided integrally with the upraised portion 3*a* via the upper 2, which can satisfy both the fittability and supportability as a shoe with a minimum of shoe components. Furthermore, the heel stability can be further improved by the actions combined with the action of the corrugated sheet 4 provided in the heel portion of the midsole 3.

As explained above in greater detail, according to the tightening structure or the wrap and fit system for an article of footwear of the present invention, fittability, supportability and stability can be advanced with a minimum of components. The tightening structure of the present invention is useful for footwear including sandals and athletic shoes.

It will thus be seen that the present invention provides a new and improved tightening structure having a number of advantages and characteristics, including those pointed out herein and others which are inherent in the invention. A number of preferred embodiments having been described by way of illustration, it is anticipated that modifications to the described forms of product will occur to those skilled in the art and that such modification and changes may be made without departing from the spirit of the invention or the scope of the appended claims.

What is claimed is:

1. A tightening system for footwear to wrap and fasten a foot of a wearer in a loop shape, said system comprising:

a supporting element having an upraised portion to support a lateral side of the foot of the wearer, said upraised portion extending and starting from a position in the vicinity of a head of a metatarsus on the lateral side of the foot over a rear portion of a calcaneus of the foot and terminating at a medial side portion of the calcaneus;

a first fastening element of a loop shape to surround the calcaneus, said first fastening element extending from the medial side portion of the calcaneus of the foot over a navicular to a lateral side portion of the calcaneus, said first fastening element being connected to said supporting element at said medial and lateral side portions of the calcaneus; and a second fastening element of a loop shape provided at a rear side position of a base of a proximal phalanx of the foot and extending over the instep from the medial side to the lateral side.

2. The tightening system for footwear of claim 1, wherein an upper end of said supporting element is positioned in the vicinity of a swell line of an outer circumference of the foot of the wearer.

3. The tightening system for footwear of claim 1, wherein said second fastening element includes a medial fastening element provided on the medial side, a lateral fastening element provided on the lateral side, and a joining element that joins said medial fastening element to said lateral fastening element.

4. The tightening system for footwear of claim 3, wherein a terminus of said medial fastening element is disposed on the lateral side beyond a shoe center line.

5. The tightening system for footwear of claim 1, wherein said first fastening element includes a first medial fastening element provided on the medial side, a first lateral fastening element provided on the lateral side, and a first joining element that joins said first medial fastening element to said first lateral fastening element.

6. The tightening system for footwear of claim 5, wherein a terminus of said first medial fastening element is disposed on the lateral side beyond a shoe center line.

7. The tightening system for an athletic shoe of claim 1 further comprising a midsole formed of a soft elastic material, wherein a corrugated sheet having a corrugation is interposed at least at a heel portion of said midsole.

8. The tightening system for an athletic shoe of claim 1 wherein said first fastening element includes an inside wall portion which extends upwardly toward the navicular of the foot on the medial side supporting the navicular to raise it up with the navicular wrapped in the inside wall portion.

9. The tightening system for an athletic shoe of claim 1 wherein said first fastening element has a width terminating in the vicinity of the mid-foot on the medial side of the foot.

10. The tightening system for an athletic shoe of claim 1 wherein said second fastening element has a first and second end, said first end being integral with said supporting element and said second end extending over the instep from the medial side to the lateral side for attachment to said supporting element.

11. A tightening system for an athletic shoe having a shoe upper to wrap and fasten a foot of a wearer in a loop shape, said system comprising:

a supporting element having an upraised portion to support a lateral side of the foot of the wearer, said upraised portion extending and starting from a position in the vicinity of a head of a metatarsus on the lateral side of the foot over a rear portion of a calcaneus of the foot and terminating at a medial side portion of the calcaneus;

a first fastening element of a loop shape to surround the calcaneus, said first fastening element extending from the medial side portion of the calcaneus of the foot over a navicular to a lateral side portion of the calcaneus, said first fastening element being connected to said supporting element at said medial and lateral side portions of the calcaneus;

wherein said first fastening element includes a first medial fastening element provided on the medial side, a first lateral fastening element provided on the lateral side, and a first joining element that joins said first medial fastening element to said first lateral fastening element;

wherein at least a portion of said first medial fastening element and said first lateral fastening element is provided outside a shoe upper of said shoe;

a second fastening element of a loop shape provided at a rear side position of a base of a proximal phalanx of the foot and extending over the instep from the medial side to the lateral side;

wherein said second fastening element includes a second medial fastening element provided on the medial side, a second lateral fastening element provided on the lateral side, and a second joining element that joins said second medial fastening element to said second lateral fastening element;

wherein at least a portion of said second medial fastening element and said second lateral fastening element is provided outside a shoe upper of said shoe.

12. The tightening system for an athletic shoe of claim 11, wherein an upper end of said supporting element is positioned in the vicinity of a swell line of an outer circumference of the foot of the wearer.

13. The tightening system for an athletic shoe of claim 11 further comprising a midsole formed of a soft elastic material, wherein a corrugated sheet having a corrugation is interposed at least at a heel portion of said midsole.

14. A tightening system for an athletic shoe to wrap and fasten a foot of a wearer in a loop shape, said system comprising:

a shoe upper;

a supporting element having an upraised portion to support a lateral side of the foot of the wearer, said upraised portion extending and starting from a position in the vicinity of a head of a metatarsus on the lateral side of the foot over a rear portion of a calcaneus of the foot and terminating at a medial side portion of the calcaneus;

a first fastening element of a loop shape to surround the calcaneus, said first fastening element extending from the medial side portion of the calcaneus of the foot over a navicular to a lateral side portion of the calcaneus, said first fastening element being connected to said supporting element at said medial and lateral side portions of the calcaneus;

wherein said first fastening element includes a first medial fastening element provided on the medial side, a first lateral fastening element provided on the lateral side, and a first joining element that joins said first medial fastening element to said first lateral fastening element;

a second fastening element of a loop shape provided at a rear side position of a base of a proximal phalanx of the foot and extending over the instep from the medial side to the lateral side;

wherein said second fastening element includes a second medial fastening element provided on the medial side, a second lateral fastening element provided on the lateral side, and a second joining element that joins said second medial fastening element to said second lateral fastening element;

wherein at least a portion of said first medial fastening element and said first lateral fastening element is provided inside said upper of said shoe.

15. The tightening system for an athletic shoe of claim 14, wherein an upper end of said supporting element is positioned in the vicinity of a swell line of an outer circumference of the foot of the wearer.

16. The tightening system for an athletic shoe of claim 14 further comprising:

A midsole formed of a soft elastic material, wherein rear end portions of said first medial fastening element and said first lateral fastening element or rear end portions of said second medial fastening element and said second lateral fastening element are attached to said shoe upper or a heel portion of said midsole, wherein front end portions of said first medial fastening element and said first lateral fastening element or front end portions of said second medial fastening element and said second lateral fastening element are connected to said first joining element, wherein intermediate portion of said first medial fastening element and said first lateral fastening element or intermediate portion of said second medial fastening element and said second lateral fastening element are disconnected from said shoe upper.

17. The tightening system for an athletic shoe of claim 14 further comprising a midsole formed of a soft elastic material, wherein a corrugated sheet having a corrugation is interposed at least at a heel portion of said midsole.

18. A tightening system for an athletic shoe to wrap and fasten a foot of a wearer in a loop shape, said system comprising:

a supporting element having an upraised portion to support a lateral side of the foot of the wearer, said upraised portion extending and starting from a position in the vicinity of a head of a metatarsus on the lateral side of the foot over a rear portion of a calcaneus of the foot and terminating at a medial side portion of the calcaneus;

a first fastening element of a loop shape to surround the calcaneus, said first fastening element extending from the medial side portion of the calcaneus of the foot over a navicular to a lateral side portion of the calcaneus, said first fastening element being connected to said supporting element at said medial and lateral side portions of the calcaneus;

wherein said first fastening element includes a first medial fastening element provided on the medial side, a first lateral fastening element provided on the lateral side, and a first joining element that joins said first medial fastening element to said first lateral fastening element;

wherein at least a portion of said first medial fastening element and said first lateral fastening element is provided in shoe upper of said shoe;

a second fastening element of a loop shape provided at a rear side position of a base of a proximal phalanx of the foot and extending over the instep from the medial side to the lateral side;

wherein said second fastening element includes a second medial fastening element provided on the medial side, a second lateral fastening element provided on the lateral side, and a second joining element that joins said second medial fastening element to said second lateral fastening element;

wherein at least a portion of said second medial fastening element and said second lateral fastening element is provided in a shoes upper of said shoes.

19. The tightening system for an athletic shoe of claim 18, wherein an upper end of said supporting element is positioned in the vicinity of a swell line of an outer circumference of the foot of the wearer.

20. The tightening system for an athletic shoe of claim 18 further comprising a midsole formed of a soft elastic material, wherein a corrugated sheer having a corrugation is interposed at least at a heel portion of said midsole.

* * * * *

UNITED STATES PATENT AND TRADEMARK OFFICE

CERTIFICATE OF CORRECTION

PATENT NO. : 6,606,804 B2
DATED : August 19, 2003
INVENTOR(S) : Kaneko et al.

It is certified that error appears in the above-identified patent and that said Letters Patent is hereby corrected as shown below:

Column 14,
Line 23, after "in", replace "a shoes upper" by -- a shoe upper --; and after "of", replace "said shoes" by -- said shoe --.

Signed and Sealed this

Thirteenth Day of January, 2004

JON W. DUDAS
*Acting Director of the United States Patent and Trademark Office*